US006802741B1

(12) United States Patent
Shatkin

(10) Patent No.: US 6,802,741 B1
(45) Date of Patent: Oct. 12, 2004

(54) ELECTRIC PLUG FOR A POWER CORD

(75) Inventor: Louis Shatkin, Warwick, RI (US)

(73) Assignee: Tower Manufacturing Corporation, Providence, RI (US)

( * ) Notice: Subject to any disclaimer, the term of this patent is extended or adjusted under 35 U.S.C. 154(b) by 0 days.

(21) Appl. No.: 10/226,091

(22) Filed: Aug. 22, 2002

(51) Int. Cl.[7] ..... H01R 13/66

(52) U.S. Cl. ..... 439/620; 439/606; 439/910; 439/490; 439/106; 200/51 R

(58) Field of Search ..... 439/620, 910, 439/490; 200/51 R; 361/42, 49–50, 111

(56) References Cited

U.S. PATENT DOCUMENTS

| | | | | | |
|---|---|---|---|---|---|
| 2,125,126 | A | | 7/1938 | Rivers | |
| 2,486,380 | A | | 11/1949 | Bauer | |
| 2,508,637 | A | | 5/1950 | Bolesky | |
| 3,769,549 | A | | 10/1973 | Bangert, Jr. | |
| 3,873,951 | A | | 3/1975 | Blake | |
| 4,307,925 | A | | 12/1981 | Drew | |
| 4,771,367 | A | | 9/1988 | Serr et al. | |
| 4,814,739 | A | * | 3/1989 | Moldovan | 337/68 |
| 4,834,664 | A | | 5/1989 | Lin | |
| 4,903,162 | A | | 2/1990 | Kopelman | |
| D319,213 | S | | 8/1991 | Wiand | |
| 5,079,530 | A | * | 1/1992 | Tsuchiyama | 335/17 |
| 5,167,535 | A | | 12/1992 | Kovacik et al. | |
| 5,262,748 | A | | 11/1993 | Tsung-Mou | |
| 5,315,476 | A | | 5/1994 | Hedrick | |
| 5,661,623 | A | | 8/1997 | McDonald et al. | |
| D391,550 | S | | 3/1998 | Stekelenburg | |
| D400,175 | S | | 10/1998 | Okamoto | |
| D420,976 | S | | 2/2000 | Kovacik et al. | |
| 6,042,418 | A | | 3/2000 | Cummings | |
| 6,176,717 | B1 | | 1/2001 | Campolo et al. | |
| 6,204,747 | B1 | | 3/2001 | Kitchens | |
| 6,212,048 | B1 | * | 4/2001 | Chaudhry | 361/42 |
| 6,267,627 | B1 | | 7/2001 | Lin | |
| 6,325,673 | B1 | | 12/2001 | Mai | |
| 2001/0012732 | A1 | | 8/2001 | Kitchens | |

* cited by examiner

*Primary Examiner*—Tho D. Ta
*Assistant Examiner*—Xuong Chung-Trans
(74) *Attorney, Agent, or Firm*—Kriegsman & Kriegsman

(57) ABSTRACT

An electric plug includes a plug housing which is formed onto one end of a power cord, the power cord includes a hot line, a neutral line and a ground line. The electric plug includes a lighted rocker switch which provides both circuit breaking and power switching capabilities, the rocker switch being electrically connected to the hot and neutral lines of the power cord. First, second and third conductive terminals project orthogonally out from the plug housing. The first and second conductive terminals are electrically connected to the rocker switch and the third conductive terminal is electrically connected to the ground line. In use, the lighted rocker switch regulates the flow of between the conductive terminals and the power cord in response to overcurrent conditions in the electric plug and manual switching of the power state of the lighted rocker switch.

13 Claims, 7 Drawing Sheets

ELECTRIC PLUG FOR A POWER CORD

BACKGROUND OF THE INVENTION

The present invention relates generally to an electric plug for a power cord and more particularly to an electric plug for a power cord which includes a circuit breaking device.

An electric plug commonly includes a plurality of conductive terminals which are sized and shaped to project into associated receptacles in an electrical outlet. The electric plug is typically formed onto the first end of a power cord. The second end of the power cord is traditionally connected to a load (e.g., a conventional electrical appliance). As an example, the second end of a power cord may be directly hardwired to the power circuit for the load. As another example, the second end of a power cord may be in the form of one or more female receptacles (i.e, in the case of an extension cord) into which a plug for the load is connected. With the electric plug for a power cord inserted into a properly functioning electrical outlet, current travels from the power source, into the outlet, through the plug, along the length of the power cord and into desired load, thereby providing the necessary electrical power for said load to operate.

Circuit breakers are well known in the art and are commonly provided along the current path to protect the load against overcurrent conditions. Specifically, a circuit breaker monitors the amount of current passing into and traveling out from a load. Whenever the amounts of incoming and outgoing current passing into and traveling out from the load exceeds the current rating of the circuit breaker (thereby signifying an overcurrent condition) or if there is an accidental short circuit in the load, the circuit breaker is opened, or tripped, thereby instantly cutting off the flow of electricity to the load, which is highly desirable. When the overload condition is eliminated, the circuit breaker can be manually reset which, in turn, restores the flow of electricity to the load.

Conventionally, circuit breakers are centrally located, particularly in a domestic establishment, with at least one circuit breaker having an average capacity of approximately 15 amperes governing each circuit.

Centrally locating circuit breakers has been found to be highly undesirable in that the amperage capacity of a centrally located circuit breaker may be excessive and the protection afforded thereby may hence be inadequate for a load with a critical power rating below that capacity. As such, the circuit breaker would fail to adequately protect against a current overload which is less than that required to open the circuit breaker but which is still large enough to considerably damage the load.

Accordingly, it is known in the art for individual circuit breakers to be integrated directly into each electric plug of a power cord.

As an example, U.S. Pat. No. 4,307,925 to D. Drew discloses a plug connector with a circuit breaker, the plug connector being engageable with an electrical outlet. The plug connector comprises an insulating body that encapsulates circuitry for providing pathways for electrical current delivered by the connector to an associated power cord. The plug connector also comprises a deep, blind-end, socket for an elongated circuit breaker. A gap is located in the circuitry for interrupting the pathway, both terminals of the gap being in position at the blind-end of the socket so as to be bridged by the circuit breaker.

As another example, U.S. Pat. No. 4,771,367 to M. J. Serr et al. discloses an injection-molded electric plug having an integral circuit breaker. The plug housing is molded directly onto the power cord and defines a circuit breaker chamber. A circuit breaker is slidably received within the chamber and is retained therein by spring fingers. The housing is elongated and the prongs extend from one of the long sides thereof so that the housing lays substantially flat against a receptacle. The prongs are angularly oriented with respect to the elongated body so that the body with not overlie adjacent receptacle outlets.

Although well known in commerce, electric plugs which include a circuit breaker often suffer from a number of notable drawbacks.

As a first drawback, electric plugs which include a circuit breaker do not provide a readily detectable indicator for notifying the user that an overcurrent condition has been detected by the circuit breaker and that, in turn, the circuit breaker has interrupted the supply of electricity to the appliance, which is highly undesirable. As a result, the consumer would not be made aware that an overcurrent condition has opened up, or tripped, the circuit breaker in the plug until such time that the user is required to use the electrical appliance and recognizes power is no longer being supplied thereto, which is highly undesirable.

As a second drawback, electric plugs which include a circuit breaker do not enable the consumer to manually open the circuit which, in turn, interrupts the supply of electricity to the appliance, which is highly undesirable. Specifically, it has been found that in certain circumstances the consumer would want the supply of electricity to the appliance to be temporarily interrupted (e.g., when repairing, maintaining or upgrading the appliance). In the absence of a manually operable switch, the user is required to physically remove the plug from the electrical outlet, which is considerably time consuming and labor intensive.

As a third drawback, electric plugs which include a circuit breaker often include a small push-button for manually resetting (i.e., closing) the circuit after the circuit interrupter experiences a trip condition, which is highly undesirable. As can be appreciated, the manual actuation of a small push-button does not provide the consumer with an adequate tactile physical response as to whether the push-button was properly depressed.

As a fourth drawback, electric plugs which include a circuit breaker are not typically constructed for outdoor use, which is highly undesirable. Specifically, electric plugs which include a circuit breaker are not typically water resistant, thereby limiting their range of potential applications.

SUMMARY OF THE INVENTION

It is an object of the present invention to provide a new and improved electric plug for a power cord.

It is another object of the present invention to provide an electric plug as described above which includes a circuit interrupter that trips in response to overcurrent conditions.

It is yet another object of the present invention to provide an electric plug as described above which includes a readily detectable indicator for notifying the user that the circuit interrupter has tripped in response to an overcurrent condition.

It is still another object of the present invention to provide an electric plug as described above which enables the user to manually interrupt the flow of electricity through said electric plug.

It is yet still another object of the present invention to provide an electric plug as described above which includes means for manually resetting the circuit interrupter after a tripped condition, said means providing adequate tactile response for the user.

It is another object of the present invention to provide an electric plug as described above which is constructed for outdoor use.

It is yet another object of the present invention to provide an electric plug as described above which may be mass produced, has a minimal number of parts, and can be easily assembled.

Accordingly, as one feature of the present invention, there is provided an electric plug for a power cord, said power cord comprising a hot line, a neutral line and a ground line, said electric plug comprising a combination circuit breaker and power switch device electrically connected to the hot and neutral lines of said power cord, and first, second and third conductive terminals, said first and second conductive terminals being electrically connected to said combination circuit breaker and power switch device, said third conductive terminal being electrically connected to said ground line, wherein said combination circuit breaker and power switch device regulates the flow of current between said first and second conductive terminals and said power cord.

As another feature of the present invention, there is provided a method of manufacturing an electric plug for a power cord, said power cord comprising a hot line, a neutral line and a ground line, said method comprising the steps of providing a combination circuit breaker and power switch device, mounting at least one protective casing onto said combination circuit breaker and power switch device, slidably disposing a transparent plastic cover over said combination circuit breaker and power switch device, fittingly disposing a heated sleeve over said transparent plastic cover to create a seal of said transparent plastic cover over said combination circuit breaker and power switch device, electrically coupling first and second terminals to said combination circuit breaker and power switch device, electrically coupling a third terminal to said ground line, and electrically coupling said combination circuit breaker and power switch device to said hot line and said neutral line, and molding a plug housing over said combination circuit breaker and power switch device.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration specific embodiments for practicing the invention. These embodiments will be described in sufficient detail to those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. In the drawings wherein like reference numerals represent like parts.

DETAILED DESCRIPTION OF PREFERRED EMBODIMENTS

Figure 1:
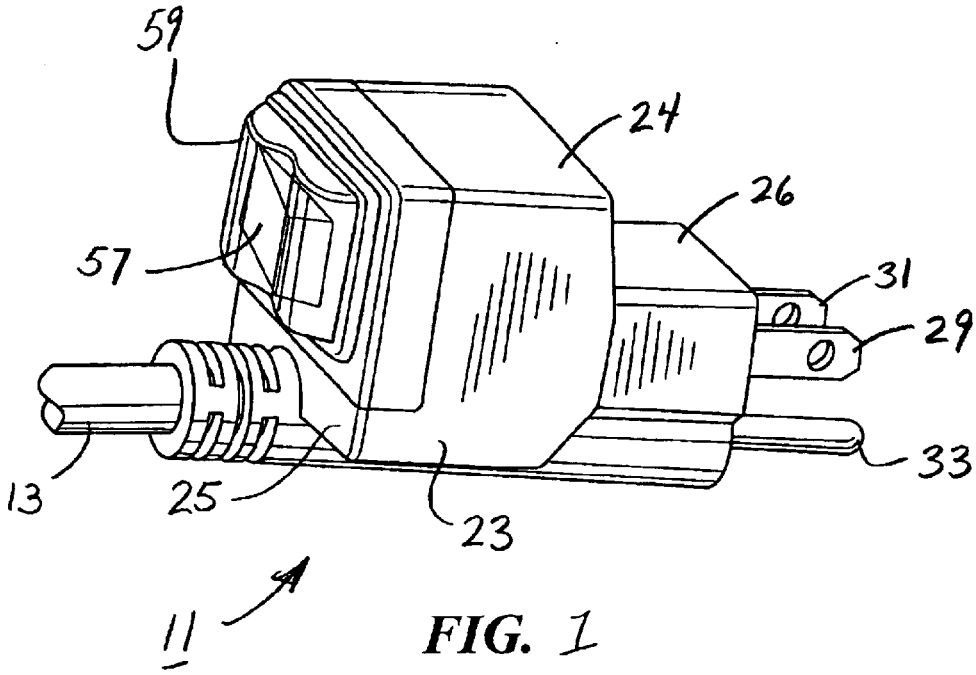
FIG. 1 is a fragmentary, perspective view of a first embodiment of an electric plug for a power cord, the electric plug being constructed according to the teachings of the present invention, the electric plug being formed onto one end of a power cord.
Figure 2:
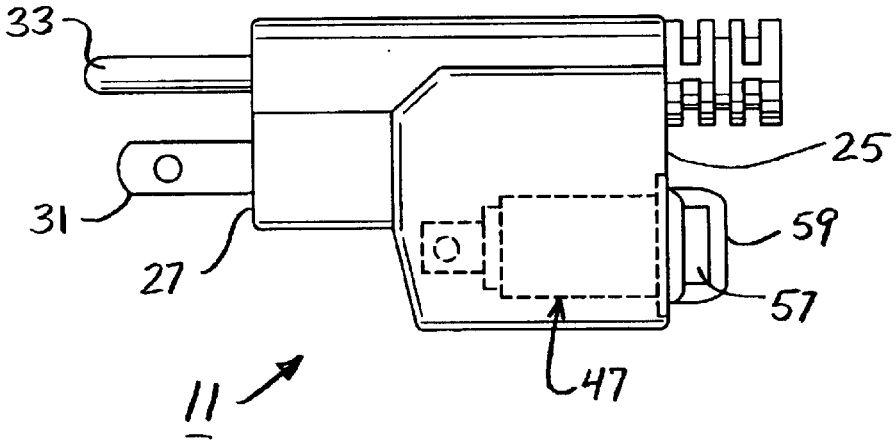
FIG. 2 is a front plan view of the electric plug shown in FIG. 1.
Figure 4:
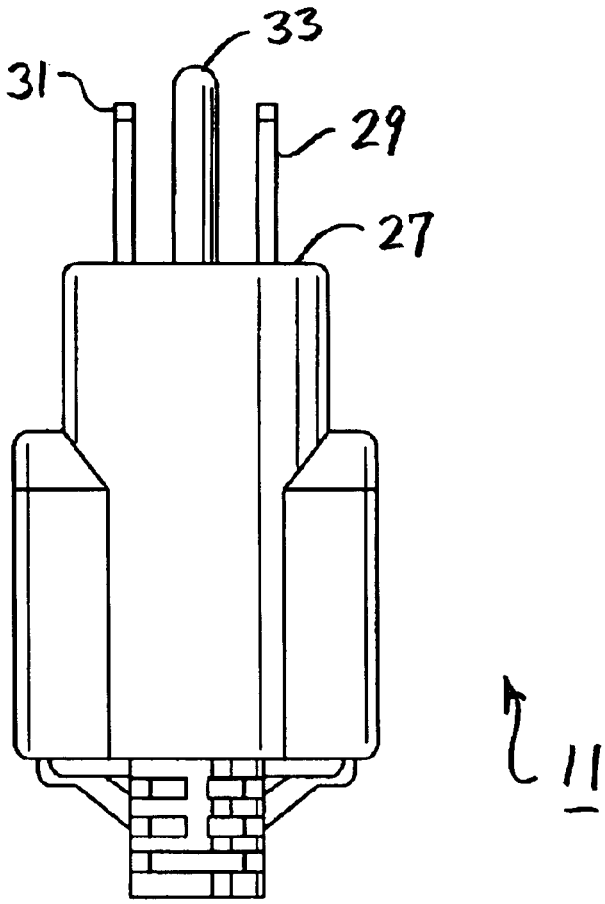
FIG. 4 is a top plan view of the electric plug shown in FIG. 1.
Figure 3:
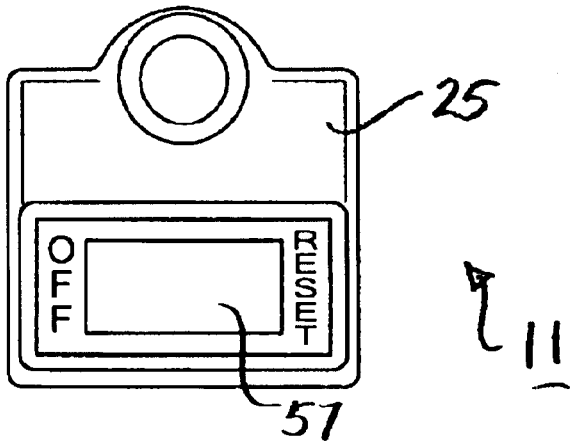
FIG. 3 is a right side view of the electric plug shown in FIG. 1.

Referring now to FIGS. 1–6, there is shown a first embodiment of an electric plug constructed according to the teachings of the present invention, the electric plug being represented generally by reference numeral 11.

Electric plug 11 is electrically connected to the first end of a power cord 13. Power cord 13 is conventional in construction and includes a hot line 15, a neutral line 17 and a ground line 19 which are all wrapped together by an outer protective sheath 21 constructed of an insulated material. The second end of power cord 13 is preferably connected to a desired load, such as a conventional electrical appliance. As an example, the second end of power cord 13 may be directly hardwired to the power circuit for the load. As another example, the second end of power cord 13 may be in the form of one or more female receptacles (i.e, in the case of an extension cord) into which a plug for the load is connected. As such, with electric plug 11 inserted into a properly functioning electrical outlet, current travels from the power source, into the electrical outlet, through electric plug 11, along the length of power cord 13, and into the desired load, thereby providing the necessary electrical power for said load to operate.

Electric plug 11 comprises a plug housing 23 which is constructed of an insulated material, such as plastic. Plug housing 23 comprises an enlarged rectangular member 24 and a reduced sized rectangular member 26 which are integrally formed together in an end-to-end relationship, member 24 comprising a substantially flat left side surface 25 and member 26 comprising a substantially flat right side surface 27.

A hot line terminal 29, a neutral line terminal 31 and a ground terminal 33 project out from right side surface 27 of plug housing 23 in a spaced apart relationship. As will be described further in detail below, terminals 29, 31 and 33 are all sized and shaped to project into associated openings in an electrical outlet and serve as conduits through which power from the outlet is able to pass onto power cord 13.

Hot line terminal 29 is in the form of a flat, conductive blade which includes a first end 35 and a second end 37. Hot line terminal 29 is disposed to project orthogonally out from right side surface 27 of plug housing 23, with first end 35 being disposed within plug housing 23 and second end 37 projecting out from right side surface 27.

Neutral line terminal 31 is in the form of a flat, conductive blade which includes a first end 39 and a second end 41. Neutral line terminal 31 is disposed to project orthogonally out from right side surface 27 of plug housing 23 at an angle parallel with hot line terminal 29, with first end 39 being disposed within plug housing 23 and second end 41 projecting out from right side surface 27.

Ground line terminal 33 is in the form of an elongated pin which is generally circular in lateral cross-section, terminal 33 having a first end 43 and a second end 45. Ground line terminal 33 is disposed to project orthogonally out from right side surface 27 of plug housing above terminals 29 and 31, with first end 43 being disposed within plug housing 23 and second end 45 projecting out from right side surface 27.

Electric plug 11 also comprises a combination circuit breaker and power switch device 47. Device 47 represents any conventional lighted rocker switch which provides both circuit breaking and power switching capabilities. Preferably, device 47 is a lighted rocker switch of the type manufactured and sold by Joemex Electric Corporation of Taiwan under the name M1 Series Rocker Switch Circuit Breaker.

Figure 5:
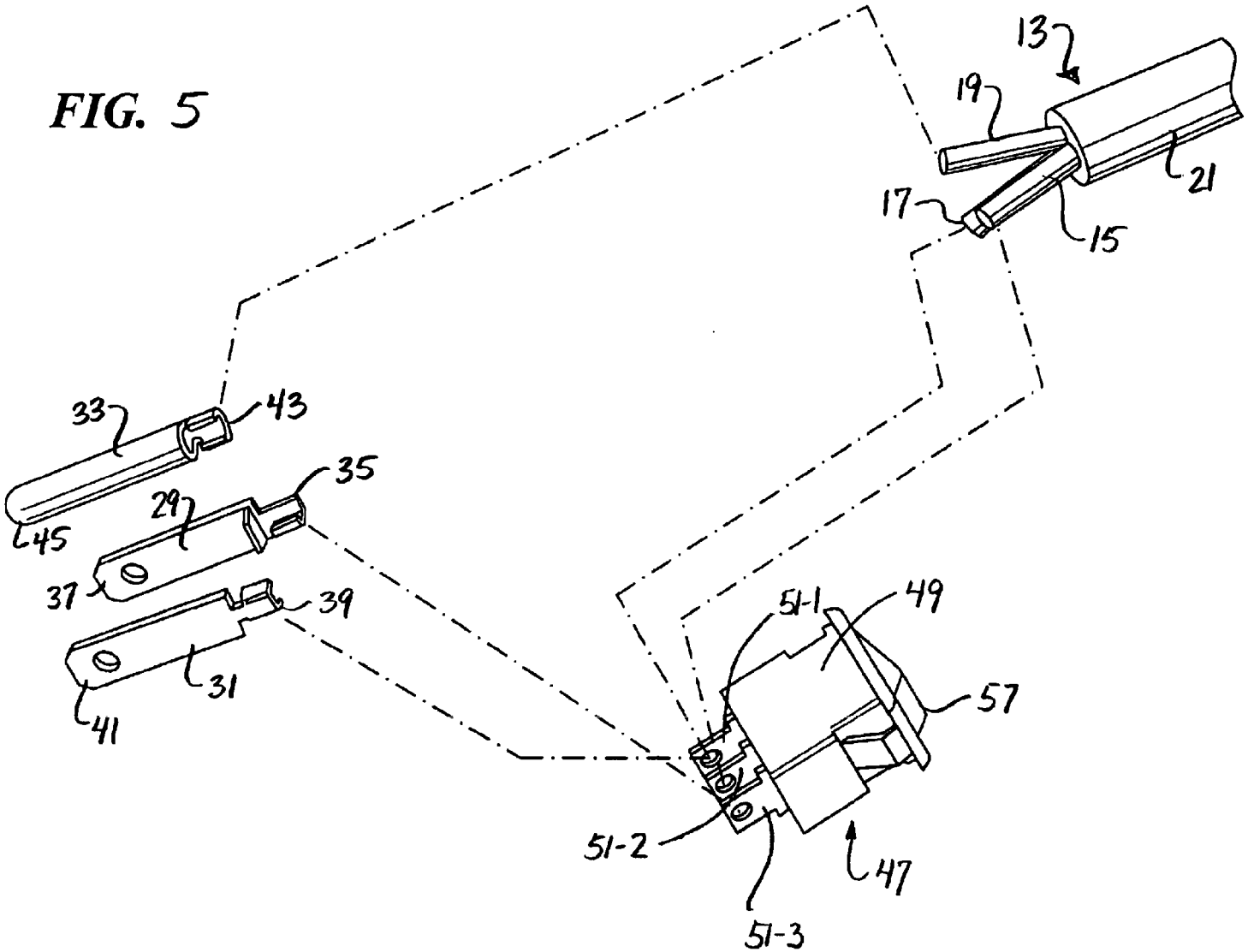
FIG. 5 is an exploded, fragmentary, perspective view of the switch, terminals and power cord shown in FIG. 1.

As seen most clearly in FIG. 5, device 47 includes a generally rectangular device housing 49 which is constructed of an insulated material, such as plastic. Device 47 also comprises first, second and third blades 51-1, 51-2, 51-3, respectively. Blades 51 are constructed of a conductive material and project out from the interior of housing 49 in a parallel relationship.

Figure 6:
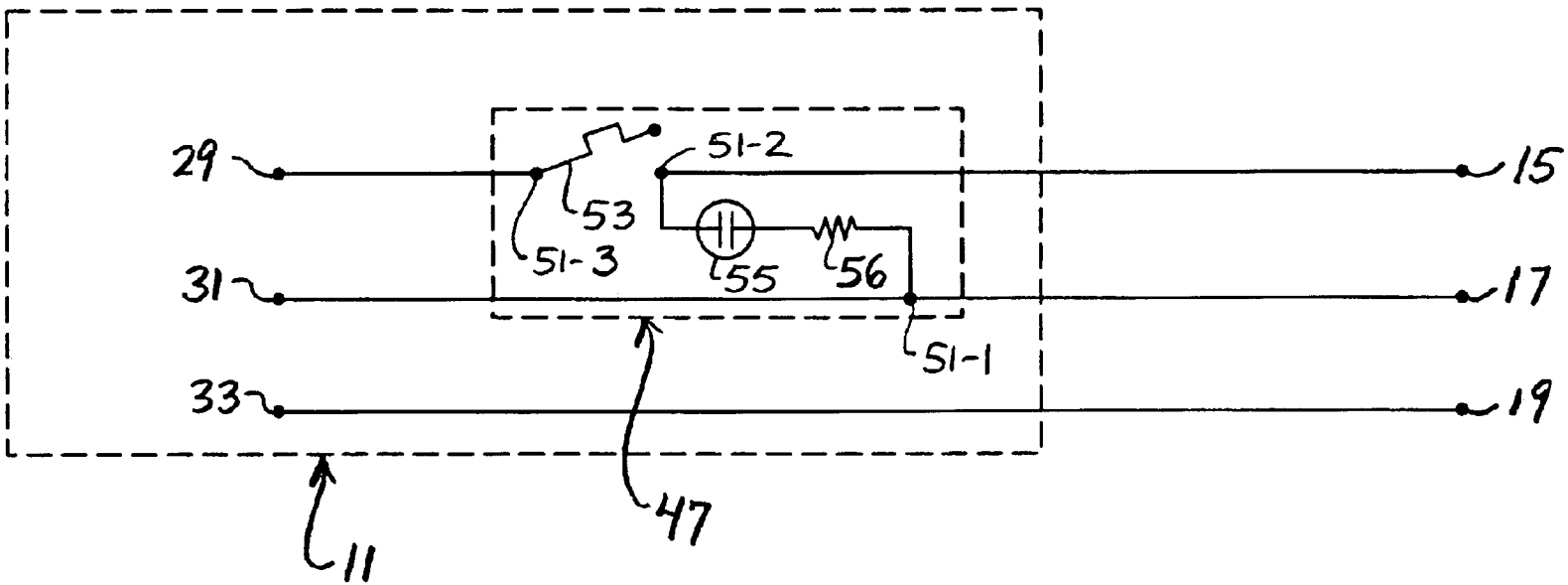
FIG. 6 is a schematic representation of the electric plug shown in FIG. 1, the electric plug being shown electrically connected to the power cord.
Figure 7C:
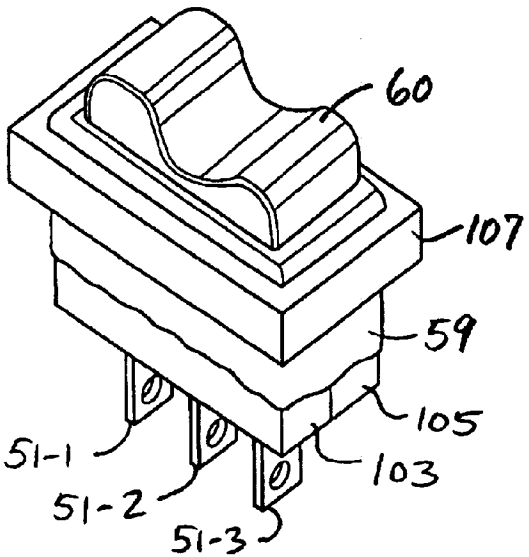
FIGS. 7(*a*)–7(*e*) are perspective views of the electric plug shown in FIG. 1 at various stages during its manufacturing process.
Figure 7B:
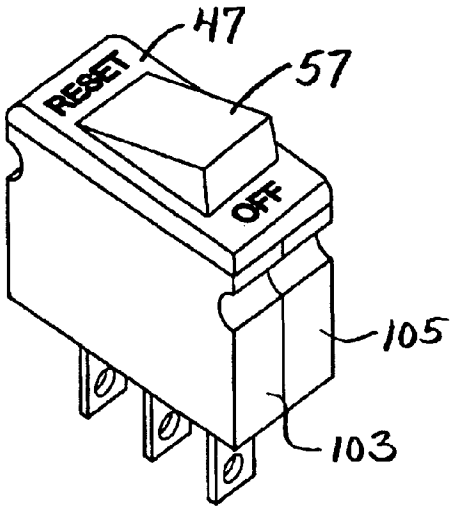
Figure 7A:
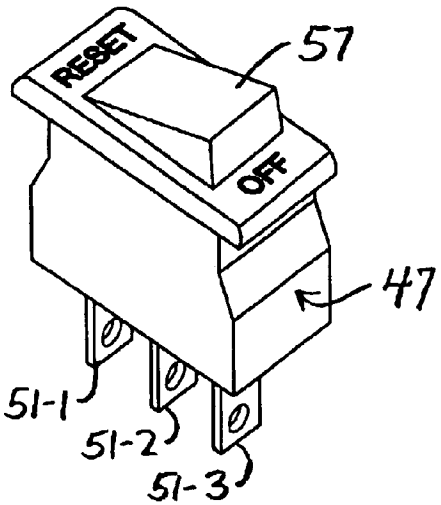
Figure 7D:
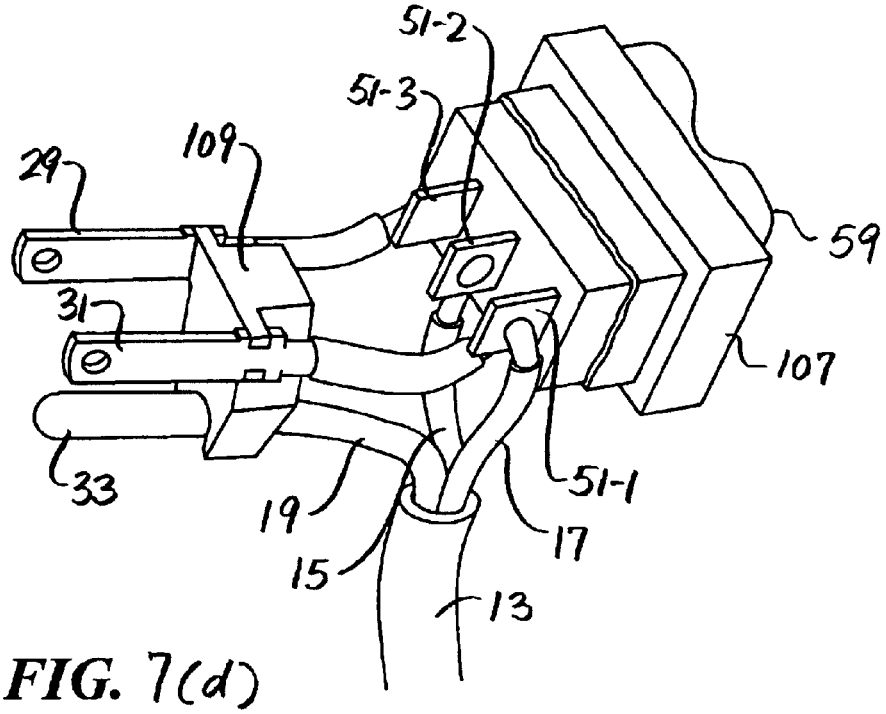
Figure 7E:
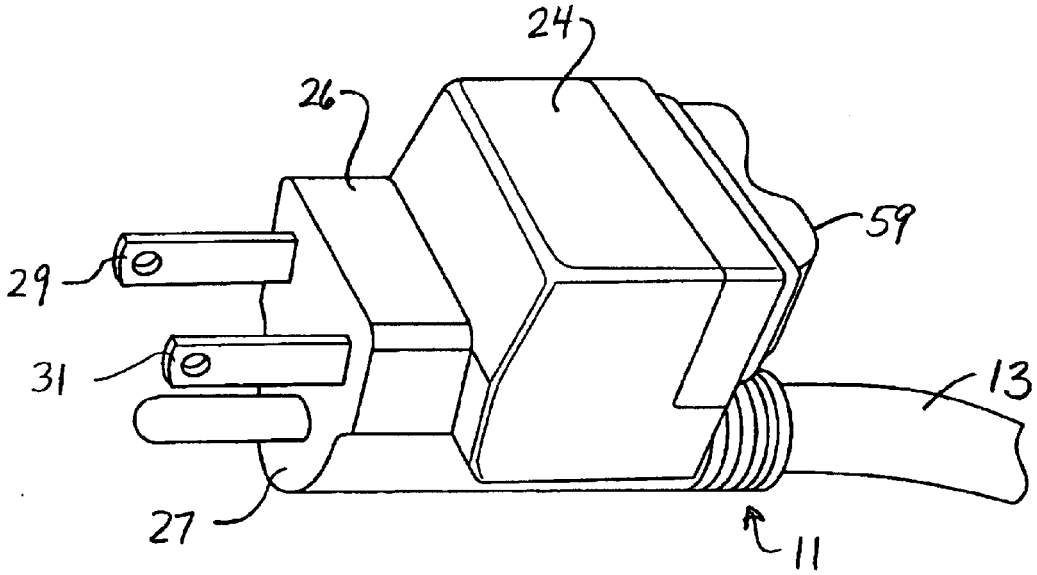

As seen most clearly in FIG. 6, a single-pole, single-throw, normally open switch 53 is disposed within the interior of device housing 49 and serves to selectively connect second blade 51-2 with third blade 51-3. As will be described further below, switch 53 is capable of being disposed between an open position and a closed position. Furthermore, a light 55 and a resistor 56 are connected in series and are disposed within the interior of device housing 49, the free end of light 55 being connected to second blade 51-2 and the free end of resistor 56 being connected to first blade 51-1.

It should be noted that light 55 is preferably in the form of a neon lamp. However, it is to be understood that light 55 is not limited to a neon lamp. Rather, light 55 represents any conventional device that produces light, such as a light emitting diode (LED), without departing from the spirit of the present invention.

As will be discussed further below, with switch 53 disposed in its open position, current fails to travel through light 55 and, as a consequence, light 55 does not illuminate. To the contrary, with switch 53 disposed in its closed position, current supplied by hot line 15 travels through light 55 and, as a consequence, light 55 illuminates. As a result, light 55 serves as a visual indicator of the switching state of switch 53.

Device 47 further comprises an actuation button 57 which is mounted onto device housing 49, button 57 preferably being a rocker-type actuation button. Pivotal displacement of button 57 serves to effectively open and close switch 53. Specifically, button 57 is capable of being pivoted between a RESET position which, in turn, disposes switch 53 in its closed position, and an OFF position which, in turn, disposes switch 53 in its open position (the RESET and OFF positions of button 57 being identified in FIG. 3).

It should be noted that actuation button 57 is capable of being either manually pivoted (i.e., as a power switch) or automatically pivoted (i.e., as a circuit breaker) so as to effectively change the state of switch 53, which is highly desirable.

It should also be noted that actuation button 57 is constructed of a translucent material, such as plastic. As such, with light 55 illuminated, light produced from light 55 is capable of passing through actuation button 57 so as to provide the consumer with a visual indication of the present switching state of switch 53, which is highly desirable.

A transparent protective cover 59 is mounted onto plug housing 23 over actuation button 57. Transparent protective cover 59 is water resistant and is mounted onto plug housing 23 using a water-tight seal. As such, protective cover 59 enables electric plug 11 to be used in outdoor applications, which is highly desirable.

FIGS. 7(*a*)–(*e*) depict a multi-staged process for manufacturing electrical plug 11. It should be noted that the process for manufacturing electrical plug 11 as shown in FIGS. 7(*a*)–(*e*) represents one novel process for manufacturing electrical plug 11. However, it is to be understood that electrical plug 11 is not limited to the particular manufacturing process depicted in FIGS. 7(*a*)–(*e*). Rather, it is to be understood that electrical plug 11 could be constructed using alternative manufacturing processes without departing from the spirit of the present invention.

As shown in FIG. 7(*a*), the manufacturing process begins simply by providing combination circuit breaker and power switch device 47. First and second protective casings 103 and 105 are individually molded and are mounted over device 47, as shown in FIG. 7(*b*). As can be appreciated, casings 103 and 105 serve to protect device 47 during future steps of the manufacturing process. In particular, casings 103 and 105 serve to protect device 47 when device 47 is molded into plug housing 23.

With protective casings 103 and 105 mounted onto device 47, separately molded transparent plastic cover 59 is slidably disposed over device 47 and protective casings 103 and 105. Transparent plastic cover 59 includes a wavy surface 60 which is positioned over actuation button 57 of device 47.

A separately molded sleeve 107 is constructed of plastic. Sleeve 107 has a rectangular shape and includes a generally rectangular central opening. During the manufacturing process, sleeve 107 is placed in boiling water, the heat of the boiling water enabling sleeve 107 to be slightly stretched. The heated sleeve 107 is then slidably mounted over transparent plastic cover 59, sleeve 107 being stretched in such a manner so as to fit snugly over transparent plastic cover 59. As such, sleeve 107 creates a water-tight seal of transparent plastic cover 59 over device 47, as shown in FIG. 7(*c*).

Having mounted protective casings 103 and 105, transparent cover 59 and sleeve 107 onto device 47, power cord 13 is electrically coupled to terminals 51 of device 47. Specifically, hot line 15 is electrically coupled through a wire to second blade 51-2 of device 47 and neutral line 17 is electrically coupled through a wire to first blade 51-1 of device 47. In addition, first terminal 29 is electrically coupled through a wire to third blade 51-3 of device 47, second terminal 31 is electrically coupled through a wire to first blade 51-1 of device 47 and third terminal 33 is electrically coupled through a wire to ground line 19. It should be noted that first terminal 29, second terminal 31 and third terminal 33 are all held in place in a spaced apart relationship by an insulated, plastic spacer (or mounting block) 109, as shown in FIG. 7(*d*).

Finally, plug housing 23 is molded over the device as represented in FIG. 7 (*d*) so as to form electrical plug 11, as shown in FIG. 7(*e*). Preferably, plug housing 23 is formed through two separate molding processes.

In use, electrical plug 11 can be used in following manner to power a load which is connected to power cord 13. Specifically, actuation button 57 of electrical plug 11 is initially disposed in its RESET position which, in turn, closes switch 53. Electrical plug 11 is then plugged into an electrical outlet which, in turn, derives power from a power source.

With actuation button 57 of electrical plug 11 disposed in its RESET position and in the absence of an overcurrent condition, switch 53 remains closed. As such, the power supplied from the power source passes into the electrical outlet, to electrical plug 11, through power cord 13 and into the load, thereby providing the load with the necessary power to operate, which is highly desirable. The passing of current through electrical plug 11 causes light 55 to illuminate, thereby providing the user with a visual indicator (i.e., a light) that power is being properly passed to the load, which is highly desirable.

Upon the presence of an overcurrent condition, device 47 in plug 11 detects said condition and, in response, automatically pivots actuation button 57 to its OFF position which, in turn, opens up switch 53. With switch 53 opened, or tripped, current is no longer able to pass from the electrical outlet to the load, thereby protecting the load from the overcurrent condition, which is highly desirable. Furthermore, terminating the flow of current through plug 11 causes light 55 in device 47 to turn off, thereby providing the user with a visual indicator (i.e., a lack of light) that power is no longer being supplied to the load, which is highly desirable. When the overcurrent condition has passed, the user can manually reset switch 53 by pivoting actuation button 57 to its RESET position which, in turn, returns switch 53 to its closed position.

In addition, it should be noted that device 47 functions as a power switch. As such, the user can manually dispose actuation button 57 in either its RESET position or its OFF position, as desired. Specifically, when the user pivots actuation button 57 to its OFF position, switch 53 opens and light 55 does not illuminate. To the contrary, when the user pivots actuation button 57 to its RESET position, switch 53 closes and light 55 illuminates.

Figure 8:
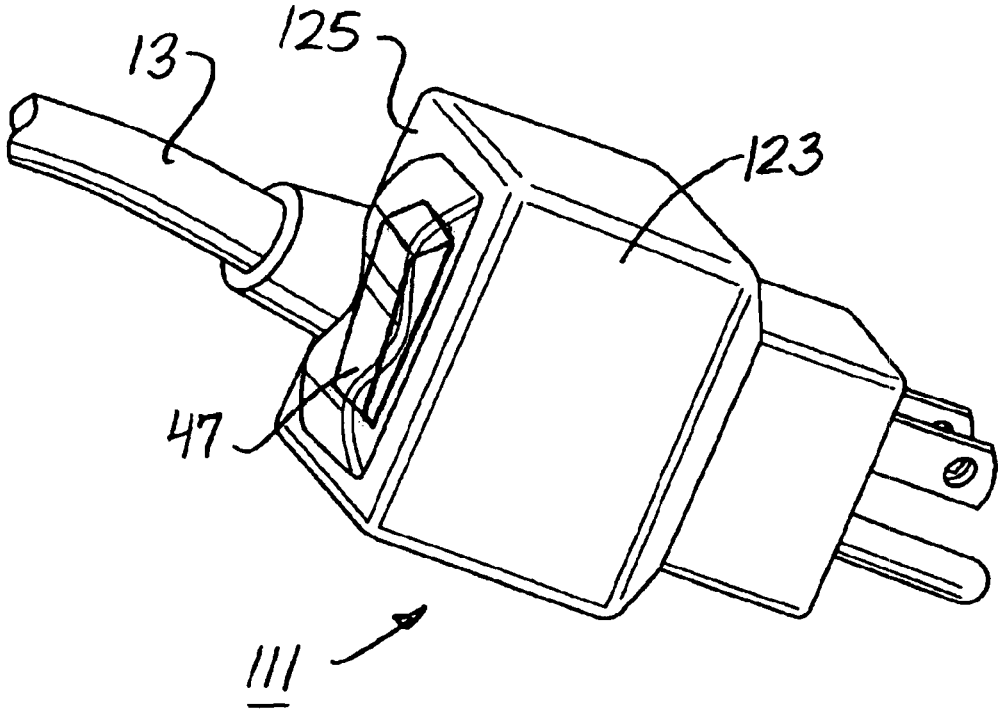
FIG. 8 is a fragmentary, perspective view of a second embodiment of an electric plug for a power cord, the electric plug being constructed according to the teachings of the present invention, the electric plug being formed onto one end of a power cord.

It should be noted that electrical plug 11 is not limited to the particular design shown in FIG. 1. Rather, it is to be understood that the particular size, shape and configuration of electrical plug 11 could be modified without departing from the spirit of the present invention. For example, referring now to FIG. 8, there is shown a second embodiment of an electrical plug constructed according to the teachings of the present invention, the electrical plug being identified generally by reference numeral 111.

The principal distinction between electrical plug 111 and electrical plug II lies in the orientation and relative placement of power cord 13 and device 47 in relation to the remainder of the plug. Specifically, in electrical plug 111, device 47 extends vertically along right end wall 125 of plug housing 123, with device 47 and power cord 13 being arranged in a side-by-side relationship. To the contrary, in electrical plug 11, device 47 extends horizontally along right end wall 25 of plug housing 23, with device 47 located directly above power cord 13.

The versions of the present invention described above are intended to be merely exemplary and those skilled in the art shall be able to make numerous variations and modifications to it without departing from the spirit of the present invention. All such variations and modifications are intended to be within the scope of the present invention as defined in the appended claims. For example, it should be noted that the particular components which make up the aforementioned embodiments may be interchanged or combined to form additional embodiments.

What is claimed is:

1. An electric plug for a power cord, said power cord comprising a hot line, a neutral line and a ground line, said electric plug comprising:

(a) a combination circuit breaker and power switch device electrically connected to at least one of the hot and neutral lines of said power cord, said combination circuit breaker and power switch device providing said electric plug with circuit breaking and power switch capabilities, said combination circuit breaker and power switch device comprising a switch which can be manually disposed between an open position and a closed position using a pivotable actuation button, (b) first, second and third conductive terminals, at least one of said first and second conductive terminals being electrically connected to said combination circuit breaker and power switch device, said third conductive terminal being electrically connected to said ground line, (c) a transparent water resistant cover mounted over the pivotable actuation button, and (d) a sleeve fittingly mounted over the transparent plastic cover so that a water-tight seal is created around the pivotable actuation button by the transparent water resistant cover, (e) wherein said combination circuit breaker and power switch device selectively disposes the switch between its open and closed positions to regulate the flow of current between said power cord and at least one of said first and second conductive terminals, said combination circuit breaker and power switch device being adapted to detect an overcurrent condition present in said power cord and, in response to detecting said overcurrent condition, dispose the switch in its open position.

2. The electric plug as claimed in claim 1 wherein said combination circuit breaker and power switch device visually indicates whether said switch is in its open position or its closed position.

3. The electric plug as claimed in claim 2 wherein said combination circuit breaker and power switch device is in the form of a lighted rocker switch which provides both circuit breaking and power switching capabilities.

4. The electric plug as claimed in claim 1 wherein the actuation button is translucent.

5. The electric plug as claimed in claim 4 wherein said combination circuit breaker and power switch device comprises a light.

6. The electric plug as claimed in claim 5 wherein said combination circuit breaker and power switch device is constructed so that said light illuminates only when said switch is disposed in its closed position.

7. The electric plug as claimed in claim 1 wherein the combination circuit breaker and power switch device comprises a first conductive prong, a second conductive prong and a third conductive prong.

8. The electric plug as claimed in claim 7 wherein the first conductive prong is electrically coupled to said neutral line and the second terminal, the second conductive prong is electrically coupled to said hot line and the third conductive prong is electrically coupled to said first terminal.

9. The electric plug as claimed in claim 8 wherein said combination circuit breaker and power switch device further comprises a resistor and a light which are connected in series between the first conductive prong and the second conductive prong.

10. The electric plug as claimed in claim 8 further comprising an insulated spacer for maintaining said first, second and third conductive terminals in a spaced-apart relationship.

11. The electric plug as claimed in claim 1 a further comprising a plug housing.

12. The electric plug as claimed in claim 11 wherein said switch and said first, second and third conductive terminals are at least partially disposed within said plug housing.

13. An electric plug for a power cord, the power cord comprising at least a hot line and a neutral line, said electric plug comprising:

(a) a combination circuit breaker and power switch device, the combination circuit breaker and power switch device comprising a switch connected to at least one of the hot and neutral lines for the power cord, the switch capable of being manually disposed between an open position and a closed position using a lighted rocker-type actuation button, (b) a transparent plastic cover mounted over the actuation button of the combination circuit breaker and power switch device, (c) a sleeve fittingly mounted over the transparent plastic cover so that a water-tight seal is created around the pivotable actuation button by the transparent plastic cover, (d) first and second conductive terminals, at least one of the first and second conductive terminals being electrically coupled to the switch, and (e) a plug housing molded over at least a portion of the power cord and over at least a portion of the combination circuit breaker and power switch device, (f) wherein the combination circuit breaker and power switch device provides the electric plug with both circuit breaking and power switch capabilities, the combination circuit breaker and power switch device disposing the switch between its open and closed positions to regulate the flow of current between the power cord and at least one of the first and second conductive terminals, the combination circuit breaker and power switch device being adapted to detect an overcurrent condition present in the power cord and, in response to detecting the overcurrent condition, dispose the switch in its open position.

* * * * *